US005225068A

United States Patent [19]

Bartkowski et al.

[11] Patent Number: 5,225,068

[45] Date of Patent: * Jul. 6, 1993

[54] METHOD OF COMPACTING AN ANODICALLY PRODUCED LAYER OF OXIDE ON PARTS OF ALUMINUM OR ALUMINUM ALLOY

[75] Inventors: Klaus-Dieter Bartkowski, Krefeld; Peter Venn, Wuppertal, both of Fed. Rep. of Germany

[73] Assignee: Gebr. Happich GmbH, Fed. Rep. of Germany

[ * ] Notice: The portion of the term of this patent subsequent to Apr. 7, 2009 has been disclaimed.

[21] Appl. No.: 799,756

[22] Filed: Nov. 27, 1991

Related U.S. Application Data

[63] Continuation-in-part of Ser. No. 527,574, May 23, 1990.

[30] Foreign Application Priority Data

May 26, 1989 [DE] Fed. Rep. of Germany ..... 3917187

[51] Int. Cl.[5] ..... C25D 5/00

[52] U.S. Cl. ..... 205/204; 205/203; 205/201; 148/272

[58] Field of Search ..... 205/204, 203, 201; 148/272

[56] References Cited

U.S. PATENT DOCUMENTS

| | | | |
|---|---|---|---|
| 3,257,244 | 6/1966 | Barkman | 204/37.6 |
| 4,531,979 | 7/1985 | Bohler et al. | 148/271 |
| 4,647,347 | 3/1987 | Schoener et al. | 204/37.6 |
| 4,648,911 | 3/1987 | Grüninger | 204/37.6 |
| 4,756,771 | 7/1988 | Brodalla et al. | 148/244 |
| 5,012,508 | 4/1992 | Bartkowski et al. | 205/173 |

OTHER PUBLICATIONS

Lowenheim, F. A., "Electroplating", McGraw-Hill, Inc., New York, 1978, pp. 454–467.

*Primary Examiner*—John Niebling
*Assistant Examiner*—Kishor Mayekar
*Attorney, Agent, or Firm*—Ostrolenk, Faber, Gerb & Soffen

[57] ABSTRACT

A method is described of compacting an anodically produced layer of oxide on parts of aluminum or aluminum alloy. In accordance with the invention, the oxide layer is compacted in two process stages, the parts being pretreated in the first process stage in a solution containing about 6% cobalt fluoride and about 30% nickel fluoride in completely desalinified water at about 30° C. for about 10 minutes and then being treated in a second process stage in completely desalinified water with the addition of a coating inhibitor of about 2 ml/l of triazine derivative at an operating temperature of about 70° C. to the boiling point for about 50 minutes.

7 Claims, No Drawings

METHOD OF COMPACTING AN ANODICALLY PRODUCED LAYER OF OXIDE ON PARTS OF ALUMINUM OR ALUMINUM ALLOY

This is a continuation-in-part of application Ser. No. 07/527,574 filed on May 23, 1990.

BACKGROUND OF THE INVENTION

The present invention relates to a method of compacting an anodically produced layer of oxide on parts of aluminum or aluminum-alloy.

Aluminum parts, such as aluminum stampings or rolled sections are used, inter alia, in the hardware and lighting industries or, in particular, also in automobile construction, for instance for window mounting systems or else as ornamental frames, ornamental moldings and the like. In particular, there are used aluminum or aluminum alloys parts which have an anodically produced and predominantly also a colored anodized layer. Traditionally, the parts are developed with thicknesses of the anodized layer of about 20 μm since it was assumed up to now that such layer thicknesses are necessary in order to produce, for instance, intensive colorings which provide sufficient protection against corrosion. Up to now, it has also been assumed that anodized layer thicknesses of 20 μm are necessary so that, upon the compacting of the layers, a sufficient absorption of water of crystallization takes place at temperatures of 98° C. to obtain a grid transformation of the layer which closes the pores so that the substances previously absorbed in the layers are firmly enclosed. Anodized layer thicknesses of 20 μm and more are disadvantageous since the degree of luster of the surface is considerably reduced and the optically positive impression is therefore negatively modified. Furthermore it was found that upon mechanical and thermal action, the 20 μm anodized layer can show fine hair cracks. Thus the parts cannot be used since the hair cracks can lead to corrosion. Furthermore, considerably longer dwell times (100%) in the anodizing baths are necessary in order to build up the 20 μm anodized layer. As a result of this, the cost of producing the anodized layer is increased.

SUMMARY OF THE INVENTION

The object of the present invention is so to improve a method of the aforementioned type that parts of aluminum or aluminum alloy having relatively thin anodically produced oxide layers with or without color which have a high resistance to wear and corrosion can be obtained.

This object is achieved in accordance with the invention by compacting the oxide layer in two process stages, the parts being pretreated in the first process stage in a solution of about 6% cobalt fluoride and about 30% nickel fluoride in completely desalinated water at about 30° C. for about 10 minutes and then treated in a second process stage in completely desalinated water with the addition of a coating inhibitor of about 2 m/l of a triazine or triazine derivative at an operating temperature of about 70° C. to the boiling point, for example, about 70° C. and about 98° C., for about 50 minutes.

DETAILED DESCRIPTION OF THE INVENTION

By operating in accordance with the invention, the particular advantage is obtained that anodized layers of aluminum or similar parts can now be produced with particularly thin anodized layers (10–12 μm) of high resistance to wear and corrosion.

For the production of parts of aluminum or aluminum alloy, one can proceed as follows:

In accordance with the present invention, the parts are preliminarily mechanically ground and polished and degreased or cleaned. They are then subjected to electrolytic-alkaline burnishing in order to obtain a sufficiently lustrous surface reflection. After the burnishing process, the parts are first electro-lytically anodized under direct current for the coloring. In the next stage, the parts are exposed in an electrolyte which contains metal salt, with the application of alternating current. In a subsequent process stage the absorbability of the anodicially produced oxide layer produced is utilized in order to vary the basic color by chemical incorporation of an organic azo dye. The parts are then treated in accordance with this invention in two further process stages wherein the oxide layer of the parts is compacted as last stage of the treatment, being thus protected against external influences. As stated above, for this purpose the parts are pretreated in a solution of cobalt fluoride and nickel fluoride in completely desalinated water. Substantially the following basic reaction with the oxide layer and the nickel fluoride takes place:

$$Al_2O_3 + Ni^2 + F + H_2O \xrightarrow{30^\circ C.} Al(OH)F_2 + Ni(OH)_2 + OH + AlF_3$$

In this first compacting process stage, a stable precompacting of the oxide layer is obtained.

In the second compacting process stage, the parts are treated in completely desalinated water with the addition of a coating inhibitor consisting of triazine derivative preferably a 1,3,5-triazine such as isocyanuric acid. In this way, a chemical reaction takes place first of all with the binding of the water $$(Al_2O_3 + H_2O \rightarrow 2\ AlO + OH).$$

The increase in volume of the layer produces a closing of the pores. The layer is now protected against external influences.

DESCRIPTION OF THE PREFERRED EMBODIMENT

Example 1

An aluminum or aluminum alloy part preliminarily prepared as above-described is compacted as follows: The part is first pretreated in a solution of 6% cobalt fluoride and about 30% nickel fluoride in completely desalinated water at 30° C. for about 10 minutes. The part is then treated at 70° C. in completely desalinated water with the addition of 2 ml/l of isocyanuric acid for 50 minutes.

Example 2

Example 1 is repeated except that the temperature of the treatment in completely desalinated water with the addition of 2 ml/l of isocyanuric acid for 50 minutes is 98° C.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of compacting an anodically produced relatively thin layer on parts of aluminum or aluminum-alloy, comprising compacting said oxide layer in two process stages, wherein in said first stage, said parts are treated in a solution of about 6% cobalt fluoride and about 30% nickel fluoride in completely desalinated water at about 30° C. for about 10 minutes and in said second stage said parts are treated in completely desalinated water containing about 2 ml/l of a [1,3,5-]triazine derivative at a temperature of about 70° C. to the boiling point for about 50 minutes.

2. A method according to claim 1 wherein said triazine is a 1,3,5-triazine.

3. A method according to claim 2 wherein said second stage is carried out at a temperature of about 70° C.

4. A method according to claim 3 wherein said 1,3,5-triazine derivative is isocyanuric acid.

5. A method according to claim 2, wherein said anodically produced oxide layer is 10 to 12 μm thick.

6. A method according to claim 2 wherein said second stage is carried out at about 98° C.

7. A method according to claim 6 wherein said 1,3,5-triazine is isocyanuric acid.

* * * * *